United States Patent [19]

Oka et al.

[11] Patent Number: 5,062,158

[45] Date of Patent: Nov. 5, 1991

[54] PROTECTIVE SHEETS HAVING SELF-ADHESIVE PROPERTY USED FOR WEARING ON CLOTHES AND KEEPING THEM CLEAN

[75] Inventors: Mitsuko Oka; Yoshiharu Okumura, both of Shiga, Japan

[73] Assignee: Toray Industries, Inc., Tokyo, Japan

[21] Appl. No.: 415,202

[22] PCT Filed: Jan. 5, 1989

[86] PCT No.: PCT/JP89/00002

§ 371 Date: Sep. 1, 1989

§ 102(e) Date: Sep. 1, 1989

[87] PCT Pub. No.: WO89/06093

PCT Pub. Date: Jul. 13, 1989

[30] Foreign Application Priority Data

Jan. 6, 1988 [JP] Japan ..... 63-1113

[51] Int. Cl.[5] ..... A41B 13/10; A41D 13/04

[52] U.S. Cl. ..... 2/46; 2/48; 2/49 R; 2/50; 2/51; 2/243 A; 2/243 R

[58] Field of Search ..... 2/46, 48, 49 R, 49 A, 2/50, 51, 75, 80, 243 A, 243 R, 88; 55/DIG. 39; 428/922; 427/30, 58, 79, 389.9

[56] References Cited

U.S. PATENT DOCUMENTS

| | | | |
|---|---|---|---|
| 2,617,104 | 11/1952 | Barager | 2/49 R |
| 2,907,042 | 10/1959 | Murphy | 2/48 |
| 3,067,428 | 12/1962 | Baker et al. | 2/49 R |
| 3,097,962 | 7/1963 | Whitacre et l. | 428/922 |
| 3,461,882 | 8/1969 | Epstein | 55/103 X |
| 3,654,629 | 4/1972 | Grisman et al. | 2/49 R |
| 3,665,518 | 5/1972 | Leadford | 2/49 R |
| 3,669,736 | 6/1972 | Fujiwara et al. | 428/922 X |
| 3,747,122 | 7/1973 | Goldberg | 2/48 |
| 3,793,644 | 2/1974 | Kellner | 2/49 R |
| 3,815,153 | 6/1974 | Vitol | 2/51 |
| 3,871,027 | 3/1975 | Orr | 2/49 R |
| 3,916,447 | 11/1975 | Thompson et al. | 2/46 |
| 3,930,066 | 12/1975 | Ryan et al. | 427/79 |
| 4,038,697 | 8/1977 | Levitt | 2/49 A |
| 4,039,711 | 8/1977 | Newman | 428/286 |
| 4,228,194 | 10/1980 | Meeder | 428/922 X |
| 4,232,070 | 11/1980 | Inouye et al. | 428/922 X |
| 4,330,888 | 5/1982 | Klepfer | 2/48 |
| 4,363,071 | 12/1982 | Rzepecki et al. | 428/922 X |
| 4,382,303 | 5/1983 | Lunt | 2/114 |
| 4,412,369 | 11/1983 | Carnaghi | 2/48 X |
| 4,442,552 | 4/1984 | Bolick et al. | 2/49 R |
| 4,521,450 | 6/1985 | Bjorklund et al. | 427/389.9 X |
| 4,528,222 | 7/1985 | Rzepecki et al. | 428/922 X |
| 4,588,537 | 5/1986 | Klaase et al. | 55/DIG. 39 |
| 4,617,228 | 10/1986 | Newman et al. | 427/389.8 |
| 4,743,349 | 5/1988 | Bachot et al. | 428/288 X |
| 4,789,504 | 12/1988 | Ohmori et al. | 55/155 X |
| 4,877,646 | 10/1989 | Kuhn et al. | 427/389.9 |
| 4,891,264 | 1/1990 | Daimon et al. | 428/922 X |
| 4,902,562 | 2/1990 | Bahia | 428/922 X |
| 4,917,942 | 4/1990 | Winters | 55/155 X |

FOREIGN PATENT DOCUMENTS

| | | |
|---|---|---|
| 118216 | 9/1984 | European Pat. Off. . |
| 146790 | 4/1981 | Japan . |
| 29566 | 2/1985 | Japan . |
| 78818 | 5/1986 | Japan . |
| 186568 | 8/1986 | Japan . |

OTHER PUBLICATIONS

Seikagaku (Japan) 57(1):47–54 (1985).
Verheij, H. M. et al., *Biochem. Biophys. Acta.* 747:93–99 (1983).
Seilhamer, J. J. et al., *DNA* 5:519–527 (1986).
Verger, R. et al., *Biochem.* 21:6883–6889 (1982).
Seikagaku (Japan) 58(8):766 (1986).

*Primary Examiner*—Werner H. Schroeder
*Assistant Examiner*—Jeanette E. Chapman
*Attorney, Agent, or Firm*—Armstrong, Nikaido, Marmelstein, Kubovcik & Murray

[57] ABSTRACT

The present invention relates to protective sheets used for wearing on clothes and keeping the clothes clean which have no problem such as slipping off, stripping up, falling down and so on without fixing them on bodies with strings, namely, protective sheets effectively used for aprons and napkins and practically relates to protective sheets which are the above described aprons and napkins consisting of electret sheets whose surface electric charge density is $1\times10^{-10}$ coulomb/cm$^2$ or more and weight per square meter is 10 g/m$^2$ or more and 100 g/m$^2$ or less.

14 Claims, 2 Drawing Sheets

PROTECTIVE SHEETS HAVING SELF-ADHESIVE PROPERTY USED FOR WEARING ON CLOTHES AND KEEPING THEM CLEAN

TECHNICAL FIELD

The present invention relates to protective sheets having a self-adhesive property used for wearing on clothes and keeping them clean when there exists the possibility of getting the clothes dirty, for example, during cooking, having a meal, performing a dirty operation and so on, and also relates to the above described protective sheets which are aprons and napkins which can be very effectively used as convenient disposable aprons and napkins.

BACKGROUND ART

Up to this time, when there are possibilities of getting clothes dirty, for example, during cooking, having a meal, performing a dirty operation and so on, aprons and napkins have been used for wearing on clothes and keeping them clean.

Such aprons and napkins, such as fabric-made and paper-made ones, are well known and have been widely used.

These aprons and napkins are used for only wearing on clothes and keeping them clean a the main purpose and it is therefore required to have those ones which tightly cover the clothes, give no tight feeling and are kept out of the way during cooking, taking a meal, and performing a dirty operations.

However, as conventional paper-made and fabric-made aprons of course do not have a self-adhesive property on worn clothes, it was necessary to fix an apron itself on the body side, such as by winding strings on the neck when being used and therefore there were such defects as taking time and tight feeling when being used. Moreover, there were such defects in these aprons that as these aprons were fixed on the body only by means of strings, when the aprons were worn by winding strings loosely to avoid the above described tight feeling, not only the apron main bodies were unstable and slip easily, but the apron main bodies were stripped off even with a very weak wind and were of no use as aprons. Especially, such above described problems as stripping off are important in the case of uses in roast meat restaurants and outdoor uses such as because the materials of disposable aprons were very light ones such as paper and so on.

On the other hand, it was known that so-called electret sheets having plus and minus electric charges on their surfaces exhibit self-adhesive properties and for example, in Japanese Patent Application Kokai Publication No. 51-186568, an electret material which had electric charge on the surfaces and was capable of adhering on a material having a flat surface and being at a standstill when placed, for example, wall surfaces and glasses when the activation energy of the polarized electric charge constituting the said electret material was at least 0.2 eV and more preferably, said electric charge was at least $7\times10^{-11}$ coulomb/cm$^2$, was proposed.

However, up to this time, adhering electret sheets have not been studied as a technological subject for example in the field of apparel use products except the materials having flat surfaces and being at a standstill such as these walls and glasses. Especially, in the field of apparel use products which were worn on human bodies and accompanied with movements, when electret sheets were tried to adhere on clothes, as said clothes were generally constituted of fibers and therefore contacted area between both sheets was very small, there was a problem that high adhesive strength could not be obtained and so that it was originally hard to adhere and even adhered, it was easily slipped off while movings. Therefore, it was the real circumstance that it had not been practically examined.

SUMMARY OF THE INVENTION

Taking the above described points into consideration, the present inventors have been extensively studied to obtain a new sense apron and napkin being easily used and having no problem such as stripping up and slipping off and reached sheets of the present invention having the below described characteristics.

Namely, the purpose of the present invention is to offer protective sheets which one does not need to fix on the body with strings and so on and have no problems such as slipping off, stripping up and falling down, and which are worn on clothes and keep the clothes clean, namely can be effectively used for aprons and napkins.

Protective sheets of the present invention achieving the above described purpose have the following constitution.

Namely, they are protective sheets having self-adhesive property characterized by having surface electric charge density of at least $1\times10^{-10}$ coulomb/cm$^2$ or more and weight per square meter of 10 g/m$^2$ or more and 100 g/m$^2$ or less and being used for wearing on clothes and keep them clean.

As these protective sheets of the present invention have such a feature that the sheets are self-adhesive on the clothes of the people who use the sheets, when said protective sheets are used, especially for example, as aprons, they have a unique property that said aprons themselves perfectly fit and adhere on the worn clothes of the people who wear the apron (hereinafter expressed as a self-adhesive property).

Aprons having the unique property like above can be conveniently and easily used in such application fields as aprons for taking a meal, aprons for cooking, bibs for babies or aprons for various kinds of works and so on and they can be widely, everywhere and well used because of the easiness in putting them on and off and the fact they are disposable. Moreover, they have a distinguishing characteristic that once worn, they do not easily slip off due to their self-adhesive property.

Especially, aprons having the above described effects and napkins having similar effects are very practical as they can be used for the purpose not to get clothes dirty when those people who especially need help during taking meals and have high possibility to get clothes dirty such as physically handicapped people, sick people, aged people and children take meals.

DETAILED DESCRIPTION OF THE PREFERRED EMBODIMENT

The protective sheets of the present invention will be explained in more detail by reference to the drawings and so on as shown below.

Figure 1:
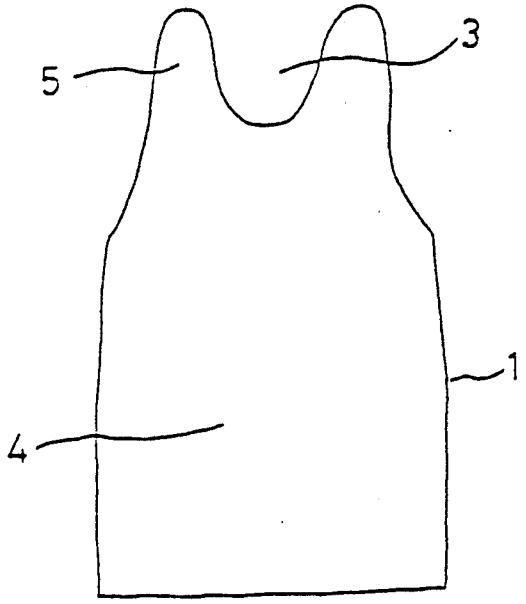
FIG. 1 shows a rough figure of the outer appearance showing an example of an apron as a practiced embodiment of protective sheets of the present invention having a self-adhesive property used for wearing on the and keeping them clean.
Figure 2:
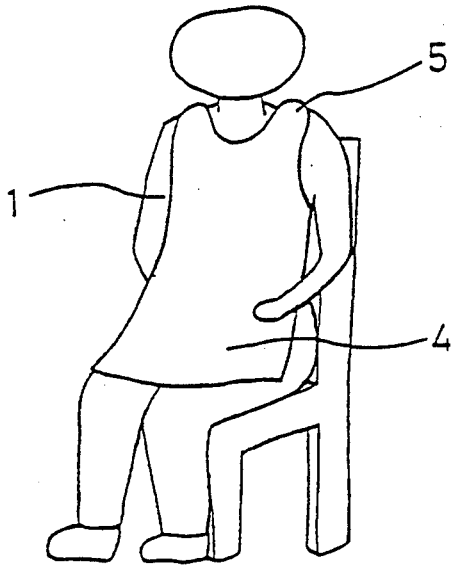
FIG. 2 shows a rough figure illustrating an example of using the apron shown in FIG. 1.

FIG. 1 shows a rough figure of the outer appearance showing an example of an apron as a practiced embodiment of protective sheets of the present invention having a self-adhesive property used for wearing on the clothes and keeping them clean, and FIG. 2 shows an example of the state when worn. The aprons of the present invention includes electric sheets having a surface electric charge density of $1\times10^{-10}$ coulomb/cm$^2$ or more and a weight per square meter of 10 g/cm$^2$ or more and 100 g/cm$^2$ or less.

Figure 3:
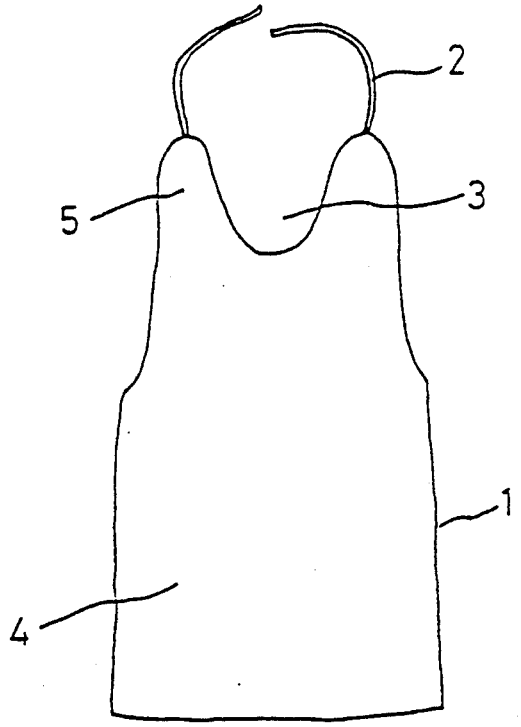
FIG. 3 shows a rough figure of the outer appearance showing another example of the practiced embodiments of the aprons as an example of the practiced embodiments of the protective sheets of the present invention having self-adhesive property used for wearing on clothes and keep them clean.

FIG. 3 shows an apron having another shape as another practiced embodiment of the present invention where strings 2 are added to the apron 1 shown in FIG. 1. Even though the protective sheets of the present invention have a self-adhesive property, strings may of course be used in parallel so that the apron is not dropped down.

Figure 4:
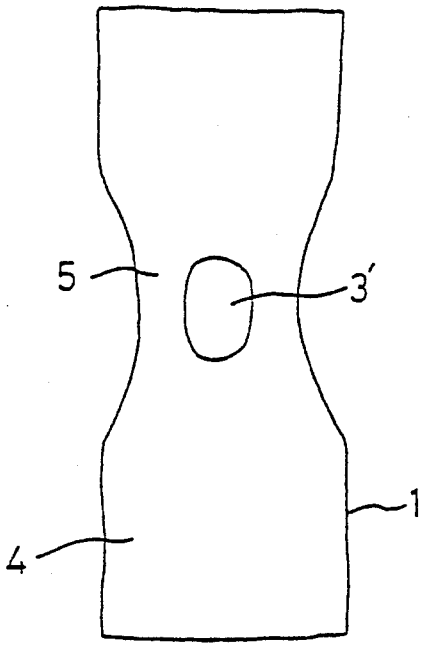
FIG. 4 similarly shows a rough figure of the outer appearance showing another example of the practiced embodiments of the aprons as an example of the practiced embodiments of the protective sheets of the present invention.
Figure 5:
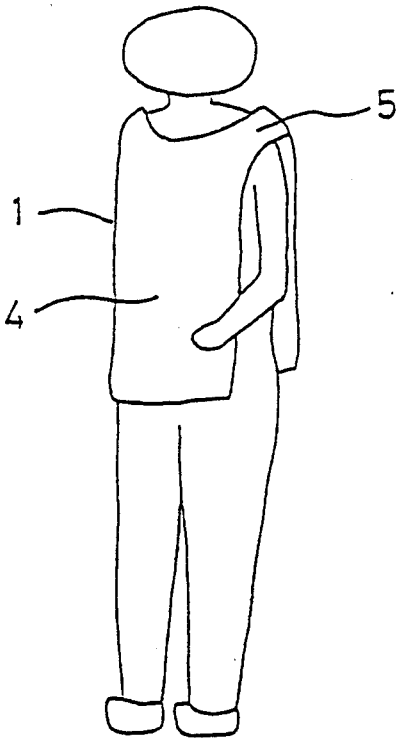
FIG. 5 shows a rough figure illustrating an example for using the apron shown in FIG. 4.

FIG. 4 furthermore shows an apron of another shape as another practiced embodiment of the present invention and FIG. 5 shows a example of the state for using it. In the examples shown in FIGS. 4 and 5, the shape is made in such a way that belly, breast and back parts, namely the front and the rear parts of the human body are covered and a hole 3' where a head is put in is opened in the center of the sheet.

Aprons shown in these figures have a constricted part 3 for the neck or a hole part 3' where a neck passes through and receiving part 4 which is an apron main body. A part 5 surrounding the neck forming the constricted part 3 for the neck covers substantially shoulders or at least reaches substantially shoulders. The whole shape of the apron is thereby constituted.

Aprons as one of the practiced embodiments of the protective sheets of the present invention are not restricted by the above described basic shapes, but if these shapes are used, the aprons will hardly fall and are more tightly fixed.

As seen from the embodiment of the protective sheets of the present invention shown in the above described drawings, those shapes having no string shown in FIGS. 1 and 4 may be called napkins rather than aprons and protective sheets of the present invention contains variety of shapes such as apron-like, napkin-like and so on. As a whole, all the protective sheets used for wearing on clothes and keep them clean are included therein.

Therefore, the shape are not restricted and besides apron-like and napkin-like ones, any shapes, for example, tetragonal and fan-shaped ones can be used.

Figure 6:
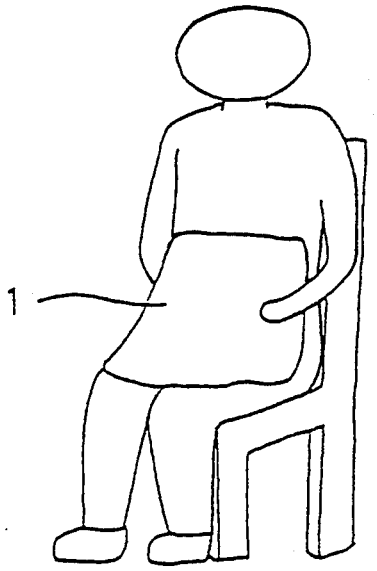
FIG. 6 shows a rough figure of the outer appearance showing an example of the practiced embodiments of the napkins as an example of the practiced embodiments of the protective sheets of the present invention having self-adhesive property used for wearing on clothes and keeping them clean.

FIG. 6 shows a rough figure of the outer appearance showing an example of the practiced embodiments of the napkins as an example of the practiced embodiments of the protective sheets of the present invention having self-adhesive property used for wearing o clothes and keeping them clean.

As described above, to use protective sheets of the present invention consisting of electret sheets being adhered on clothes and so on, it is necessary that said electret sheets have strong adhesive property and to obtain such strong adhesive property, it is essential that the surface electric charge density of the electret sheet of the present invention shows $1\times10^{31\ 10}$ coulomb/cm$^2$ or more and preferably $2\times10^{-10}$coulomb/cm$^2$ or more. The above described surface electric charge density can be obtained by placing the said sheet between two metal plates connected through a capacitor whose capacity is C (Farad), measuring the electric voltage V (V) between both ends of the capacitor and the surface area S (cm$^2$) of the said sheet and calculating the value Q by using a formula Q (coulomb/cm$^2$)$=C\times V/S$.

Moreover, it is essential that the weight per square meter is 10 g/m$^2$ or more and 100 g/cm$^2$ or less and preferably 15 g/m$^2$or more and 80 g/m$^2$ or less. If the weight per square meter is less than 10 g/m$^2$, fundamental functional characteristics as aprons and napkins protecting clothes from dirt are poor and more than 100 g/cm$^2$, adhesion is released easily by the dead-weight of the sheets and the sheets tend to fall down. These are not preferable.

Moreover, to prevent the adhered apron from obstructing various movements and falling down due to the movements, it is preferable that the sheet is made of a raw material being rich in flexibility. As such raw materials, woven and knitted fabrics, non-woven films, paper fabrics and the like can be cited. Taking flexibility into consideration, using non-woven fabrics made of synthetic fibers are preferable. If melt-blown non-woven fabrics are used as the non-woven fabrics, it is preferable because not only flexibility is excellent, but apex parts of short fibers constituting the non-woven fabrics entangle fibers constituting clothes and the adhesive property is thereby strengthened.

When non-woven fabrics are used, the cover factor of said non-woven fabrics is preferably 80% or more, and more preferably 90% or more can be used. Namely, if the cover factor is less than 80%, the adhesive force due to electrostatic charge is poor and the fundamental functional characteristics to protect clothes from dirt become poor and it is not desirable.

In the present invention, the cover factor of the non-woven fabrics is measured by the following method.

Namely, the cover factor can be obtained by preparing a shadow of a sample (10 mm$\times$10 mm) by using a magnifying projector and measuring the bright area made by transmitted light as B and the area of the shadow of the fibers as C. Numbers of measurements are 10 and the average value is calculated.

$$\text{Cover factor (\%)} = \frac{C}{B+C} \times 100$$

It is also possible that those substances which give water proof property, water repelling property and strength are applied on the surface side of the apron by means of impregnation, lamination, coating and so on and it is also desirable that dyeing, finishing and so on can be thereon treated by means of printing and so on.

Moreover, for example, when melt-blown non-woven fabrics are used and the strength is not sufficient with only said non-woven fabrics, the protective sheets of the present invention can be constituted of laminated products or adhered products of the melt-blown non-woven fabrics with spun-bonded non-woven fabrics or non-woven fabrics with short fibers. By constituting the protective sheets of the present invention as the laminated products or adhered products like above, the strength characteristics are improved and repeated use becomes possible Moreover, sufficiently satisfying characteristics can be obtained against the active movements of the users.

Moreover, to obtain higher protective effects for clothes, fibrous materials having water repellency whose contact angle with water is 80° or more are preferably used as the protective sheets. Here, the contact angle with water is defined as the angle formed between the liquid-solid interface and gas-liquid interface at the end part of the water drop when a drop of pure water is slowly dropped on a sheet placed on a horizontal plane and can be measured by means of a commercially available contact angle meter (Type CA-A manufactured by Kyowa Interfacial Science Co., Ltd.).

The protective sheets of the present invention will be practically explained by using Examples as follows.

EXAMPLE 1

Two kinds of simple aprons with a shape shown in FIG. 1 for adult people and for children were prepared as protective sheets of the present invention by using a polypropylene melt-blown non-woven fabric whose surface electric charge density is $5\times10^{-10}$ coulomb/cm$^2$ and weight per square meter is 20 g/m$^2$ (the cover factor: 99%, the contact angle with water: 91°).

These aprons were actually worn by adult people and children during taking meals to evaluate them and evaluated good as they were hardly fell down or slipped off. Especially, children did not hate to wear the aprons and were rather pleased to wear them. Moreover, they frequently moved during wearing, but little slipping off occurred and as a result, the aprons could sufficiently achieve the role for aprons.

EXAMPLE 2

An adhered sheet prepared by laminating and adhering a polypropylene spun-bonded non-woven fabrics whose weight per square meter is 20 g/cm$^2$ on a polypropylene melt-blown non-woven fabric whose surface electric charge density is $5\times10^{-10}$ coulomb/cm$^2$ and weight per square meter is 20 g/cm$^2$ which is the same as the one used in Example 1 by mean of partial heat press adhesion was used for preparing a simple apron of a shape shown in FIG. 1 as a protective sheet of the present invention.

This apron was used by making the melt-blown non-woven fabric side to be inside, and it could be well used without falling down or stripping up. As the surface side was flat and smooth, feeling on use was good, too.

INDUSTRIAL APPLICABILITY

As described above, protective sheets such as aprons, napkins and so on having adhesive property which can be repeatedly and easily worn on and off, have no need to be fixed with strings when worn on and off, and are hardly being slipped, stripped up and fallen down can be obtained by the present invention.

Protective sheets of the present invention like this are especially effective in outdoor uses where conventional protective sheets are generally hardly used, as an application embodiment.

Moreover, as another application embodiment, aprons and napkins which is one of the practiced embodiments of the protective sheets of the present invention can be used for aprons and napkins for children, bibs for babies, aprons and napkins for taking meals for sick persons and bedridden aged persons. Especially, for children and babies moving frequently, conventional paper-made and fabric-made aprons and napkins are hardly used because of being easily fallen down and protective sheets of the present invention are especially effective for such applications. Moreover, for sick persons and bedridden aged persons to whom conventional aprons with strings are not easily worn, the protective sheets of the present invention can be used as easily usable and simple protective sheets when taking a meal.

Moreover, as another application embodiment, protective sheets of the present invention can be effectively used as the protective sheets such as aprons and napkins being usable with convenient disposable feeling for taking meals in such unstable conditions as in trains, automobiles, airplanes, ships and so on.

We claim:

1. Protective sheets having self-adhesive properties used for wearing on clothes and keeping the clothes clean, comprising: at least one electret sheet which is composed of a dielectric material injected with a static electrical charge, which has a surface electric charge density which is at least $1\times10^{31\ 10}$ coulomb/cm$^2$, and whose weight per square meter is in a range of at least 10 g/m$^2$ and 100 g/m$^2$, said at least one electret sheet maintaining said static electrical charge while being worn without substantial dissipation of said static electrical charge, and said surface electric charge density being sufficient to retain said at least one electret sheet against clothing while the clothing is being worn.

2. Protective sheets as claimed in claim 1, wherein said at least one electret sheet comprises non-woven fabrics.

3. Protective sheets as claimed in claim 2, wherein said non-woven comprises synthetic fiber melt-blown non-woven fabrics.

4. Protective sheets as claimed in claim 2, wherein said non-woven fabrics have a cover factor of at least 80%, said cover factor being the ratio of a shaded area to a total of the shaded area and a lighted area when light is transmitted through said non-woven fabrics.

5. Protective sheets as claimed in claim 2, wherein said non-woven fabrics comprise laminated products of a melt-blown non-woven fabric and another non-woven fabric.

6. Protective sheets as claimed in claim 1, wherein said at least one sheet comprises fiber sheets, and wherein a contact angle of said fiber raw material sheet with water is at least 80%.

7. Protective sheets as claimed in claim 1, wherein said electret sheets are in the form of thin films.

8. Protective sheets as claimed in claim 1, wherein said electret sheets comprise woven fabric.

9. Protective sheets as claimed in claim 1, wherein said electret sheets are apron shaped products.

10. Protective sheets as claimed in claim 1, wherein said at least one electret sheet is used as an apron.

11. Protective sheets as claimed in claim 1, wherein said at least one electret sheet is used as a napkin.

12. Protective sheets having self-adhesive properties used for wearing on clothes and keeping the clothes clean, comprising: electret sheets which are composed of a dielectric material injected with a static electrical charge, said electret sheets being in the form of an apron having a constricted part for receiving the neck of a wearer, said electret sheets retaining said static electrical charge while being worn and having a surface electric charge density which is sufficient to retain said electret sheets against clothing while the clothing is being worn.

13. Protective sheets as claimed in claim 2, wherein said non-woven fabrics are adhered products of a melt-blown non-woven fabric and another non-woven fabric.

14. Protective sheets as claimed in claim 1, wherein said at least one electret sheet comprises knitted fabric.

* * * * *